US005168994A

United States Patent [19]

Beletsky et al.

[11] Patent Number: 5,168,994

[45] Date of Patent: Dec. 8, 1992

[54] HANDGUN STORAGE CONTAINER

[75] Inventors: Robert J. Beletsky; Jack B. Corwin; Gary W. French; Robert G. Morrison, all of Temecula, Calif.

[73] Assignee: Bianchi International, Temecula, Calif.

[21] Appl. No.: 818,299

[22] Filed: Jan. 9, 1992

[51] Int. Cl.[5] ..... B65D 85/00

[52] U.S. Cl. ..... 206/317

[58] Field of Search ..... 206/317

[56] References Cited

U.S. PATENT DOCUMENTS

| | | | |
|---|---|---|---|
| 3,369,721 | 2/1968 | Lentz | 206/317 |
| 3,468,427 | 9/1969 | Leslie | 206/317 X |
| 3,731,818 | 5/1973 | Young | 206/317 |
| 4,466,537 | 8/1984 | McMahan | 206/317 |
| 4,870,771 | 10/1989 | McClellan | 206/317 |
| 5,048,682 | 9/1991 | Taylor | 206/317 |
| 5,056,342 | 10/1991 | Prinz | 206/317 X |

*Primary Examiner*—William I. Price

*Attorney, Agent, or Firm*—Wagner & Middlebrook

[57] ABSTRACT

A handgun storage container is disclosed comprising a box-like enclosure having a base and an operable cover. The container is dimensioned to hold a single handgun of any of a wide variety of types and sizes. A pair of handgun holding fixtures are adjustable located within the container for engaging a handgun at two spaced locations and to precisely locate the handgun within the container. A keyless lock is used to secure the cover from opening by unauthorized persons. The container is dimensioned to locate the handgun for storage or removal by grasping the grip of the handgun and thrusting it directly into the container and automatically engaging the holding fixtures.

7 Claims, 2 Drawing Sheets

FIG. 1
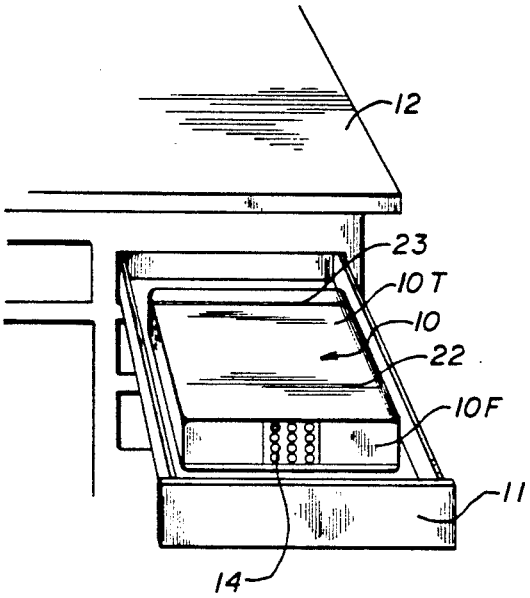
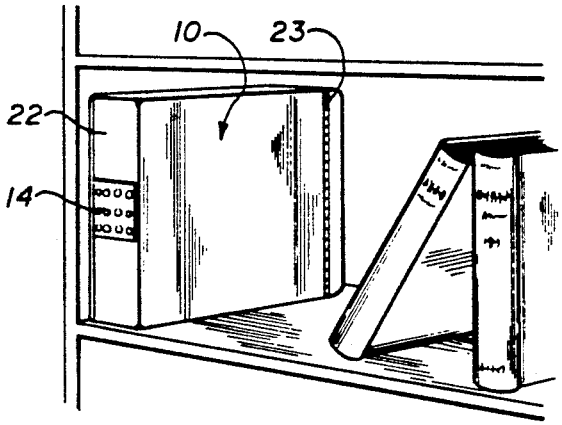
FIG. 2
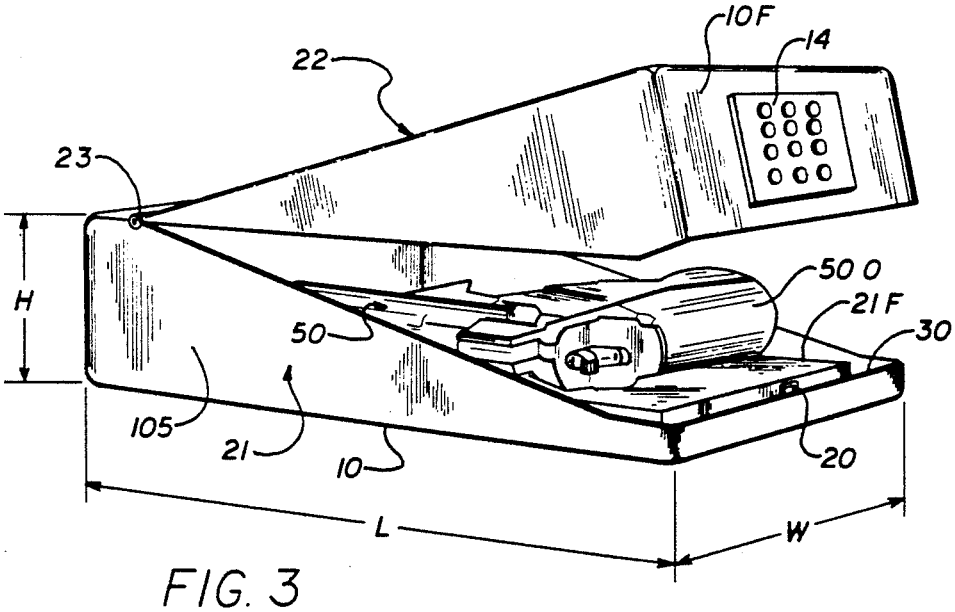
FIG. 3

FIG. 4
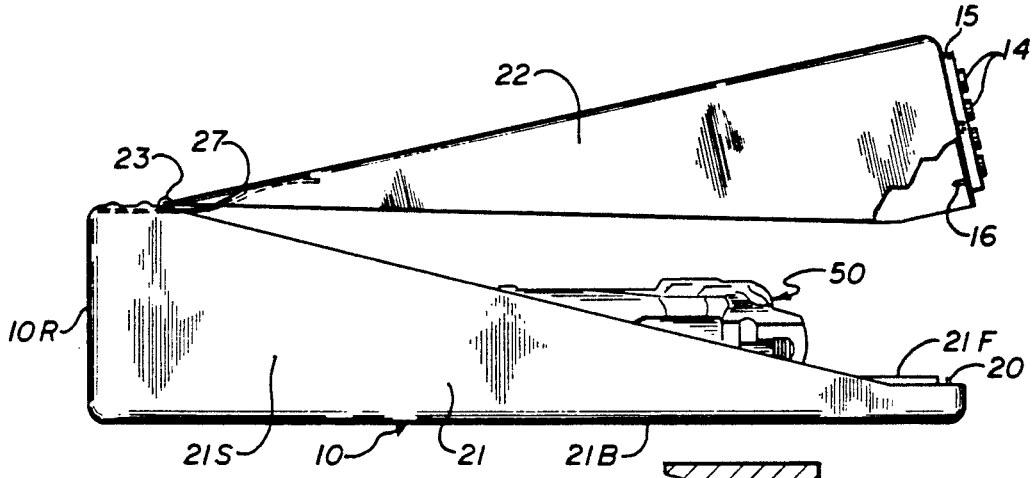
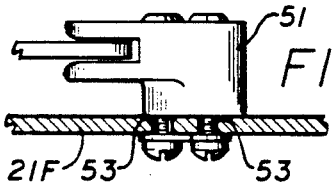
FIG. 6
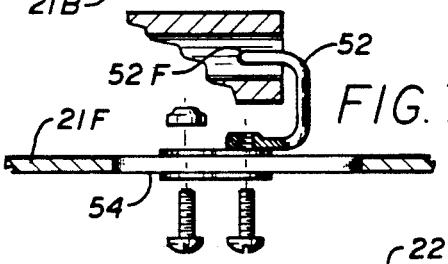
FIG. 7
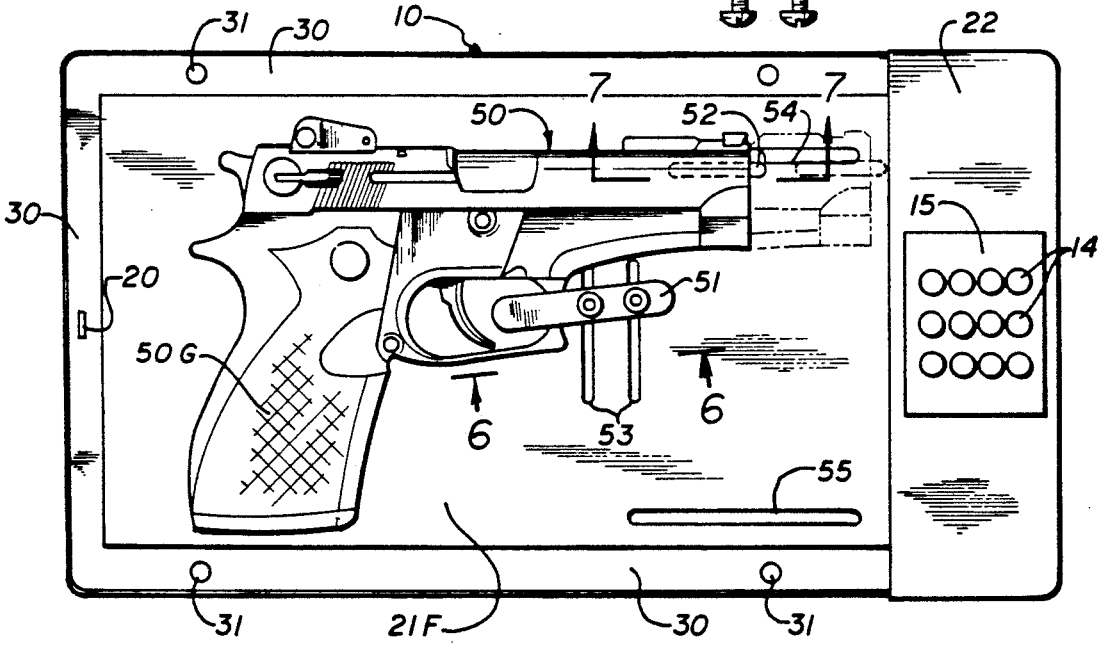
FIG. 5

HANDGUN STORAGE CONTAINER

BACKGROUND OF THE INVENTION

The safe storage of handguns in the home or workplace has been longstanding problem. The use of built-in safes or large gun storage cases is common but usually too bulky or too expensive for the typical owner of a single handgun. The result is that far too many handguns are stored in furniture drawers without any protection.

If the recommended practice of storage of ammunition at a separate location from the unloaded handgun is followed, the risk of unauthorized persons, particularly children, obtaining the handgun and then the ammunition is slight. However, the practice of leaving any handgun in an unlocked location cannot be approved.

Some lockers or lock boxes for handgun use have been designed. They often are of such size that they would hold several handguns and have a built-in lock. Unfortunately, such lockboxes are so unwieldy that they are difficult to store and when so stored do not serve as a readily accessible storage device for the authorized user. They typically cannot be stored in normal living quarters visible without being totally noticeable and as such defeats their purpose, at least in part.

We have recognized that there is a real need for an improved handgun storage container which is effective to prevent access by unauthorized persons without the destruction of the container, which may be readily stored in a bookcase, on a shelf or in drawer out of sight or access except for the owner. We also recognize that such a storage container should be readily operable by the authorized user and allow easy removal of the handgun from a predictable and easily grasped location on the storage container.

We also recognize that there is a great variety of handguns of sizes ranging from a 2" barrel revolver to 357 magnum weapon of greater length. It would be desirable to have a single storage container which would serve a wide range of handguns, without modification.

BRIEF DESCRIPTION OF THE INVENTION

Faced with the foregoing state of the art and needs, we have designed a new handgun storage device which meets the needs of handgun owners and provides additional features besides. It comprises a generally rectangular container with interior dimensions sufficient to hold a single handgun and with an end opening to allow the handgun to be drawn from that one end. The container is locked, preferably, by a keyless lock which is readily accessible from the end of the container having the grip of the handgun near the opening.

Contained within the container is a handgun holder which positions the handgun for easy insertion and removal upon opening of the access door. In its preferred embodiment the handgun is positioned by a pair of adjustable holding fixtures, one engaging the muzzle of the handgun and the other the trigger guard. The handgun is positioned in a fixed known position by the fixtures as well as support from an elevated bottom or sidewall depending upon the orientation of the container. Therefore, one can store the container in a subdued lighting location, open the end access door and reach in to the predictable location and readily remove the handgun by its grip.

In the preferred embodiment both the muzzle and trigger guard fixtures are adjustable to accommodate a wide variety of handguns. The container is of such size and design that it may be stored in a desk drawer, on a bookshelf, by being secured with concealed fasteners to a wall or almost any planar surface of a piece of furniture.

BRIEF DESCRIPTION OF THE DRAWING

This invention may be more clearly understood from the following detailed description and by reference to the drawing in which:

FIG. 1 is a perspective view of the handgun storage device of this invention stored in a desk drawer;

FIG. 2 is a perspective view of the handgun storage device of FIG. 1 stored on a bookshelf;

FIG. 3 is an additional perspective view of this invention with the cover partially raised showing a handgun in its normal stowed position;

FIG. 4 is a side elevational view of this invention with the cover partly open;

FIG. 5 is a top plan view of this invention with the cover raised to a full 90 degree open position;

FIG. 6 is a side elevational view of the trigger guard mounting fixture of this invention; and FIG. 7 is a side elevational view of the muzzle holding fixture of this invention.

DETAILED DESCRIPTION OF THE INVENTION

Now referring to FIGS. 1–4, a truly practical handgun container may be seen which is designed to hold practically any sized conventional handgun 50 in a secure convenient location and to be easily accessible. It is basically a rectangular container 10 having inside dimensions typically length 11½ inches, 29 cm
width 7¼ inches, 18.5 cm
height 2¾ inches, 7 cm with the exterior dimensions varying depending upon the material used for the container. These dimensions, although not critical, allow many different types of handguns to be easily stored in the container.

As seen in FIG. 1, the container 10 may easily be stored in a drawer 11 of a desk 12, or similar piece of furniture with assurance that it will not be openable by unauthorized persons without destroying the container. Visible at the front wall 10F of the container 10, is a keypad 14 which controls an internal lock, better seen in FIGS. 3 and 4. The keypad 14 through either mechanical linkage or electrically controls a keyless lock assembly 15 having a spring sear 16 appearing in FIG. 4 which engages an internal D shaped latch 20 which is secured within the container 10 on its base member 21. The keypad 14 and spring sear 16 are located on the cover 22 which is hinged to the base member 21 toward the rear at 23.

As is illustrated in FIGS. 1 and 2, the container of this invention may be stored flat (FIG. 1) or vertically on its long side 10S (FIG. 2) or vertically on its rear wall. In any of these cases, the container may be attached to any surface which is adjacent to its base 21B with the proviso that its front wall 10F is accessible and an amount of clearance is provided for its top wall 10T to open. An amount of clearance equal to the height H of the container is usually sufficient to allow easy removal of the handgun as may be seen in FIG. 3.

Referring specifically to FIG. 3, it may be seen that the container 10 has a raised floor 21F which is surrounded by mounting base groove 30. The groove 30 includes a plurality of mounting holes 31 which may be seen in FIG. 5 to allow the container 10 to be mounted on a surface such as the desk drawer bottom in FIG. 1 or against the side wall of the shelf of FIG. 2. When attached as by screws, the screw heads are recessed below the level of the floor 21F and do not interfere with the installation or removal of the handgun 50. It should likewise be noted in FIG. 3 that the latch 20 is located below the level of the floor 21F so that it does not interfere with the placement or removal of the handgun 50.

One of the features of this invention which makes its versatility in allowing the storage of virtually any standard handgun is illustrated in FIG. 5 with reference to FIGS. 6 and 7. In FIG. 5 the cover 22 has been raised to its full height to expose nearly the entire interior of the container 10. A 9 mm Beretta automatic pistol 50 is shown as stored in the container 10 for right hand placement and removal. The pistol 50 rests on the floor 21F and is positioned by a pair of adjustable fixtures, a forklike trigger guard retainer 51 and a muzzle retainer 52. The trigger guard retainer 51 is slidably secured to the floor 21F by screws which extend through a pair of slots 53 in the floor 21F. The slots 53 are located generally at the center of the container floor 21 with approximately 1½ in. of adjustability.

The forklike retainer 51 is effective in securing handguns in as much as it has been used in numerous holsters as is disclosed in U.S. patent application, Ser. No. 07/608,082, filed Nov. 1, 1990, now U.S. Pat. No. 5,129,562.

Likewise the muzzle retainer 52 is adjustable longitudinally in either slot 54, as shown in FIG. 5 for right hand withdrawal or in slot 55 for left hand removal. The muzzle retainer 52 is, similar to the trigger guard retainer 51, secured by screws extending through the slot 54 or 55 to the underside of the container bottom 21B. The attachment of fixtures 51 and 52 is best seen in FIGS. 6 and 7 respectively.

In use, the container cover 22 is first opened to the position shown in FIG. 5. Next, the handgun to be stored in the container is positioned in the container with the retainers 51 and 52 loosely positioned with their securing screws backed off on the underside of the container 10 to allow free movement of the retainers 51 and 52. With the handgun in its desired place and sufficient clearance so that the cover 22 may close without interference with the handgun, the screws holding the retainers 51 and 52 are tightened. With the handgun removed, the container is moved to its desired storage location. If it is to be secured in place, screws or other fasteners are inserted through the screw holes 31 into the support surface.

Next the handgun is placed in the container 10 by sliding it across the floor 21F with the muzzle enclosing the free end 52F of the U shaped muzzle retainer 52 until resistance is met as the trigger guard engages the jaws 51 of the forklike trigger guard retainer 51. A slight additional forward pressure seats the trigger guard within the retainer 51. The cover 22 may then be closed and the owner assured that unauthorized persons may not retrieve the handgun.

If the owner wanted left hand insertion and removal of the handgun, he would have first moved the muzzle retainer 52 to the slot 55, secured it in place by its screws and the stored the handgun with his left hand so that it would be in a position which would be illustrated in FIG. 5 as inverted. The grip 50G of the handgun in either case is adjacent to the front wall 10F of the container 10.

To retrieve the handgun 50, the owner operates the keypad 14 in the encoded combination such as 1, 3, 7 and the spring sear 16 is withdrawn from the catch 20. An internal spring, such as spring 27 of FIG. 4, pops the cover 21 upward or outward sufficiently for the owner to insert his hand into the container 10, grasp the grip 50G of the handgun and withdraw it directly outward overcoming the resistance of the trigger guard retainer 51. Returning the handgun is accomplished by the reversal of steps.

In the preferred embodiment a keypad and either mechanical or electrically operated lock mechanism may be used. Keyless types of locks are preferred. One mechanical type of keypad operated lock which may be used is the ten button model 4334 identified by the trade mark PBS and available from retail outlets such as the Community Locksmith of Montrose, Calif. Other types of locks may be installed in the container.

The above described embodiments of the present invention are merely descriptive of its principles and are not to be considered limiting. The scope of the present invention instead shall be determined from the scope of the following claims including their equivalents.

What is claimed is:

1. A handgun storage container comprising:

a housing including a base, an openable cover defining the walls enclosing a handgun storage space, said cover being hinged to said base for opening one end of said container, the opening being dimensioned to allow the entrance of a hand to grasp the handgun by its grip and to remove the handgun by withdrawal of the handgun through said opening;

said housing dimensioned to hold a handgun of any of a range of sizes of handguns;

means within said housing for positioning a handgun therein with the grip of the handgun accessible through the opening exposed when said cover is opened said positioning means including a pair of fixtures, one engaging the barrel portion of a handgun stored in the container and the second fixture engaging a second portion of a handgun, said second portion spaced from the first portion thereof;

said fixtures positioned to engage and release a handgun when in the container by movement to or from the opening of the container; and means for locking said cover to close said container and to prevent unauthorized opening thereof.

2. A handgun storage contained in accordance with claim 1 wherein said second fixture engages the trigger assembly of a handgun stored in the container.

3. A handgun storage container in accordance with claim 1 wherein said first fixture comprises an elongated member dimensioned to enter the barrel of a handgun and thereby position the handgun within the container.

4. A handgun storage contained in accordance with claim 3 wherein said elongated member comprises a rod including one end region adjustably secured to said container and a free end spaced from the container base and extending toward the opening in said container for locating and securing the barrel region of a handgun.

5. A handgun storage container in accordance with claim 1 wherein said second fixture includes an attachment portion for securing said second fixture to said container and a jaw portion for engaging the trigger guard of a handgun stored in said container.

6. A handgun storage container in accordance with claim 1 wherein in said first and second fixtures are each adjustably secured to said container to allow adjustment for different handguns.

7. A handgun storage container in accordance with claim 1 said first fixture is movable to two different positions with respect to said second fixture to allow either left hand or right hand insertion and removal of a handgun from said container.

* * * * *